US007696896B2

(12) United States Patent
Siber et al.

(10) Patent No.: US 7,696,896 B2
(45) Date of Patent: Apr. 13, 2010

(54) FIRE DETECTOR

(75) Inventors: Bernd Siber, Glonn (DE); Stefan Sittenauer, Munich (DE)

(73) Assignee: Robert Bosch GmbH, Stuttgart (DE)

( * ) Notice: Subject to any disclaimer, the term of this patent is extended or adjusted under 35 U.S.C. 154(b) by 853 days.

(21) Appl. No.: 10/586,084

(22) PCT Filed: Nov. 23, 2004

(86) PCT No.: PCT/EP2004/053048

§ 371 (c)(1),
(2), (4) Date: Jul. 13, 2006

(87) PCT Pub. No.: WO2005/069243

PCT Pub. Date: Jul. 28, 2005

(65) Prior Publication Data

US 2008/0246618 A1 Oct. 9, 2008

(30) Foreign Application Priority Data

Jan. 16, 2004 (DE) ..... 10 2004 002 592

(51) Int. Cl.
*G08B 23/00* (2006.01)

(52) U.S. Cl. ..... 340/693.5; 403/348; 403/349; 403/368; 340/628; 340/577

(58) Field of Classification Search ..... 340/693.5, 340/628–630, 577–579; 403/348, 349, 368
See application file for complete search history.

(56) References Cited

U.S. PATENT DOCUMENTS

| | | | | |
|---|---|---|---|---|
| 2,209,193 | A * | 7/1940 | Derby | 337/310 |
| 3,246,312 | A * | 4/1966 | McGinn | 340/632 |
| 3,900,795 | A * | 8/1975 | Larsen et al. | 324/537 |
| 4,053,777 | A | 10/1977 | Berger et al. | |
| 4,056,727 | A * | 11/1977 | Beyersdorf | 250/385.1 |
| 6,522,254 | B1 * | 2/2003 | Yamano | 340/630 |
| 7,365,846 | B2 * | 4/2008 | Hess et al. | 356/338 |
| 2002/0006042 | A1 * | 1/2002 | Marquardt et al. | 362/267 |
| 2006/0007009 | A1 * | 1/2006 | Hess et al. | 340/628 |
| 2006/0017580 | A1 * | 1/2006 | Hess et al. | 340/630 |
| 2008/0246618 | A1 * | 10/2008 | Siber et al. | 340/577 |

FOREIGN PATENT DOCUMENTS

| | | |
|---|---|---|
| DE | 197 33 375 | 2/1999 |
| DE | 101 18 913 | 11/2002 |
| GB | 2 276 970 | 10/1994 |
| JP | 06 111154 | 4/1994 |
| WO | WO 97/05586 | 2/1997 |

OTHER PUBLICATIONS

Patent Abstracts of Japan, vol. 018, No. 394, Jul. 22, 1994.

* cited by examiner

*Primary Examiner*—Daniel Wu
*Assistant Examiner*—Bradley E Thompson
(74) *Attorney, Agent, or Firm*—Kenyon & Kenyon LLP

(57) ABSTRACT

A fire detector including a base and a fire detector insert connectable to the base. The fire detector insert is connectable to the base by an axial movement and detachable from the base by a subsequent axial movement.

21 Claims, 5 Drawing Sheets

FIRE DETECTOR

FIELD OF THE INVENTION

The present invention relates to a fire detector.

BACKGROUND INFORMATION

Fire detectors are used for early recognition of fires in areas having a corresponding fire load, to protect people and material assets. Fire detectors are typically mounted on the ceiling and have a round, white housing having a diameter of approximately 10 cm and a height of approximately 7 cm to 10 cm. Because of its function, the housing is seated on the ceiling. Fire detectors are industrially mass-produced products and fire detectors of one model and manufacturer typically appear identical. The corresponding housing size may normally be immediately recognized on the ceiling as a fire detector in spaces having public traffic. The uniformity of mass production and the housing shape therefore always represent a compromise between the function of the fire detector and the taste of the user and the visual demands of the surroundings.

Scattered light fire detectors are therefore predominantly mounted on ceilings, because the smoke is first transported to the ceiling due to the thermal generated by the fire and then propagates along the ceiling. This has the disadvantage that the installation, maintenance, and function testing of the fire detector must be performed on the ceiling. At least a ladder and, in taller rooms, even a lift platform is necessary for these activities. This results in a high outlay in time and money for the cited activities. Therefore, it is desirable to be able to perform the maintenance and regular function testing of the fire detectors using testing devices mounted on a long rod. Furthermore, a defective fire detector is also to be easily replaceable using a tool insert mounted on a rod. For this reason, nearly all fire detectors are inserted into a base to which the necessary supply and transmission lines are permanently connected. Contacts are located in the base, via which the fire detector is connected to these lines. Even when a fire alarm system is first put into operation, the fire detector is to be mountable in the base with the aid of a tool insert of this type, since often the installation and wiring of the base is performed by another company and, sometimes, a long time before the installation of the fire detector itself. Thus, a ladder and/or lift platform is only necessary for wiring the base. The fire detector is predominantly installed in the base, as described in WO 97/05586, for example, by inserting the fire detector in a specific orientation in the base and attaching it using a rotational movement, like a bayonet closure. Therefore, the tool insert used on the installation tool for installing the fire detector in the base is tailored to the shape of the fire detector, in such a way that the frictional force required for the rotational movement is applied via a form fit.

A scattered light smoke detector, which has a light transmitter and a light receiver which are positioned in such a way that a scatter point outside the scattered light smoke detector is situated in the open air, the scattered light smoke detector having a cover for protecting the light transmitter and the light receiver, as well as means for differentiating between smoke and other foreign bodies located in an area around the scatter point, is described in German Patent Application No. DE 101 18 913 A1. The means for differentiating between smoke and other foreign bodies has a processor for analyzing the variation over time of received signals of the light receiver, the processor being connectable to the light receiver. The technology for recognizing a fire employed in this scattered light smoke detector allows an installation of the scattered light smoke detector generally flush with the ceiling. An important step for unobtrusive mounting of fire detectors of this type has thus already been taken. Such a fire detector which is insertable flush with the ceiling requires, however, that it generally only has a flat or only slightly curved and smooth surface, which is formed by a cover disk which covers the fire detector. Therefore, it is extraordinarily difficult to install fire detectors of this type in a base using a rotational movement. Only comparatively low frictional forces may be transmitted via the smooth, flat surface of the fire detector, much lower frictional forces than via a form fit, which is typical in the current fire detectors. In the worst case, the frictional force which may still be applied is no longer sufficient to engage the fire detector contacts with the base contacts. Since the fire detector now terminates flush with the ceiling after being inserted into the base, it is additionally very probable that the mounting tool will slip along the ceiling during the required rotational movement and mark or even damage it.

Furthermore, a scattered light smoke detector which has two light receivers or an imaging lens for a light receiver to set a defined measuring volume is described in German Patent Application No. DE 101 18 913 A1.

SUMMARY

An example fire detector designed according to the present invention may offer the advantage of easy mounting and dismounting for maintenance purposes or the like. This is because a fire detector in accordance with the present invention in which a fire detector insert of the fire detector may be installed in its base and removed again not through a rotational movement, but rather through a movement in the axial direction, i.e., perpendicular to the ceiling. The fire detector insert is pressed into the base during installation and is locked solidly in the base after being released. The fire detector insert is removed from the base by pressing on the fire detector insert again in axial direction and subsequently relieving the pressure on the fire detector insert. Since generally two defined mounting states occur here, this achievement of the object may also be referred to as a type of "mechanical flip-flop". This type of mounting is made possible by a catch which includes a connecting member that is mounted centrally and rotatably in the base. Lugs positioned on the fire detector insert cooperate with this connecting member, which cooperate with diagonally running control faces of the connecting member and convert axial movements of the fire detector insert into a rotational movement of the connecting member. A favorable mounting position between the fire detector insert and the base is particularly expediently ensured by a mechanical coding, which only permits mounting of the fire detector insert in the base in a specific position.

BRIEF DESCRIPTION OF THE DRAWINGS

The present invention is explained in greater detail below with reference to the figures.

DETAILED DESCRIPTION OF EXAMPLE EMBODIMENTS

Figure 1:
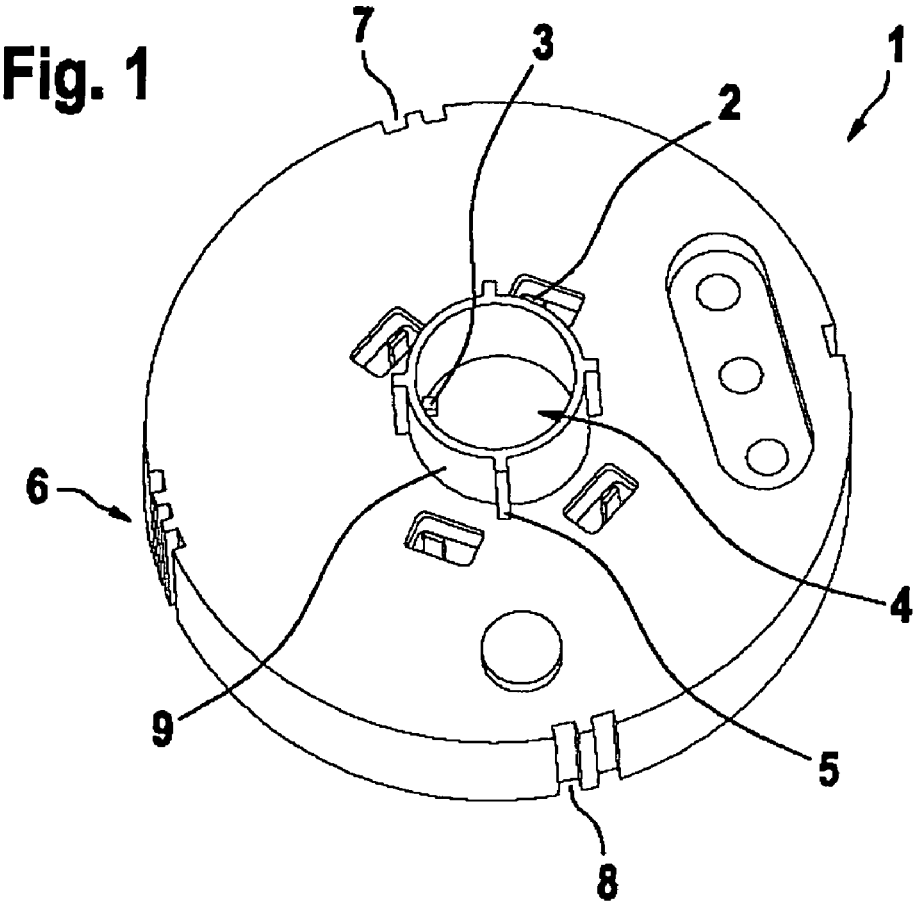
FIG. 1 shows the back of a fire detector insert of a ceiling-flush fire detector.
Figure 2:
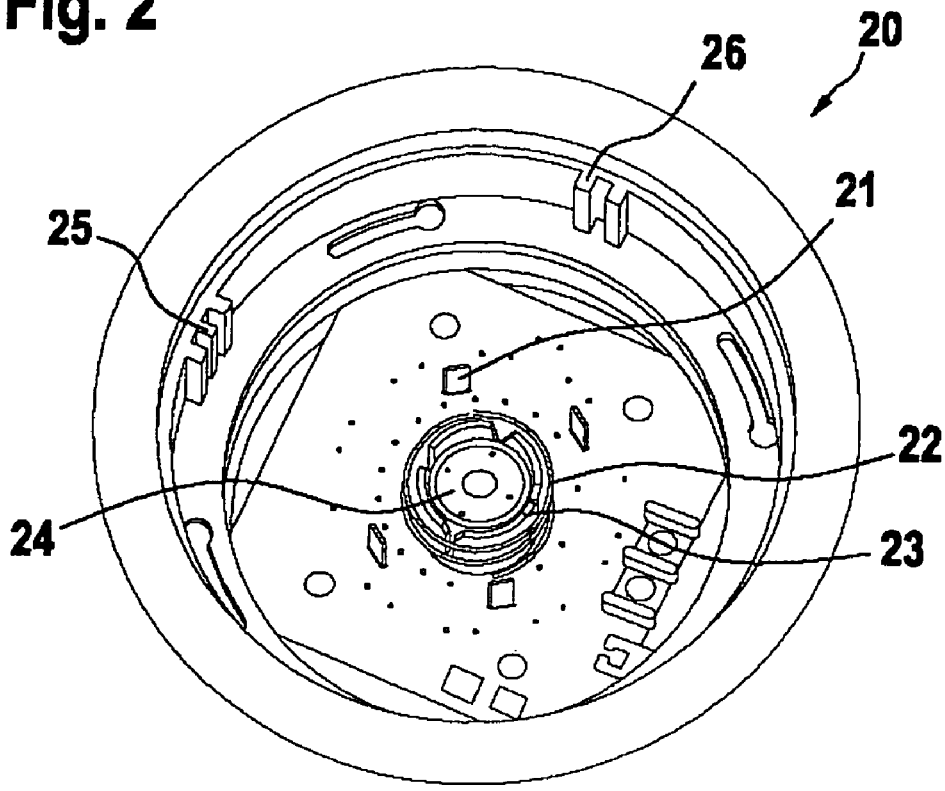
FIG. 2 shows the base of a ceiling-flush fire detector.

FIG. 1 and FIG. 2 show components of a fire detector which may be installed flush with the ceiling. FIG. 1 shows a view of the back of a fire detector insert 1. FIG. 2 shows a view of the interior of a base in which the fire detector insert illustrated in FIG. 1 may be installed. A cover disk, which is used for covering the fire detector insert, is not illustrated in the figures. Fire detector insert 1 carries a neck 9, implemented generally as a hollow cylinder, on its back. Lugs 3, 5, which project radially inward and radially outward, respectively, and whose function will be discussed further below, are positioned on the inner circumference and on the outer circumference of neck 9. Furthermore, grooves 6, 7, 8 are positioned distributed around the outer circumference of fire detector insert 1. Fire detector insert 1 also has electrical contacts 2 in its central area, which match corresponding contacts 21 in base 20. Base 20 of the fire detector illustrated in FIG. 2 is generally hat-shaped and is intended for installation in an appropriately deep recess in a ceiling. The rim of hat-shaped base 20 rests on the ceiling in the installed position in this case. Lugs 25, 26, which project radially inward, matching grooves 6, 7, 8 positioned on fire detector insert 1 and form a mechanical coding to guarantee a specific orientation of fire detector insert 1 and base 20 to one another, are positioned on the inner circumference of base 20. A dome 35 is positioned so it projects concentrically into the interior of base 20. Dome 35 is enclosed by a rotatably mounted connecting member 23, which is held-by a disk 24 attached by a screw 33. Disk 24 is connected to dome 35 so that they rotate together. Connecting member 23, which is rotatable around dome 35, is also positioned so it is rotatable in relation to disk 24. A catch arrangement 31, 34 allows defined catch positions between connecting member 23 and disk 24, however. Connecting member 23 illustrated in FIGS. 3, 4, 5, 6, and 7 carries diagonally set control faces on its external circumference, which correspond to lugs 3 provided in fire detector insert 1. During the axial movement of fire detector insert 1 in relation to base 20 required for the assembling and/or disassembling of fire detector insert 1, a force is transmitted via lugs 3 to control faces of connecting member 23, which results in a rotational movement of connecting member 23. Base 20 also includes a pressure spring 22, which concentrically encloses dome 35. This pressure spring 22 loads the fire detector insert with a pressure force in the installed position and thus secures it in a catch position.

Figure 3:
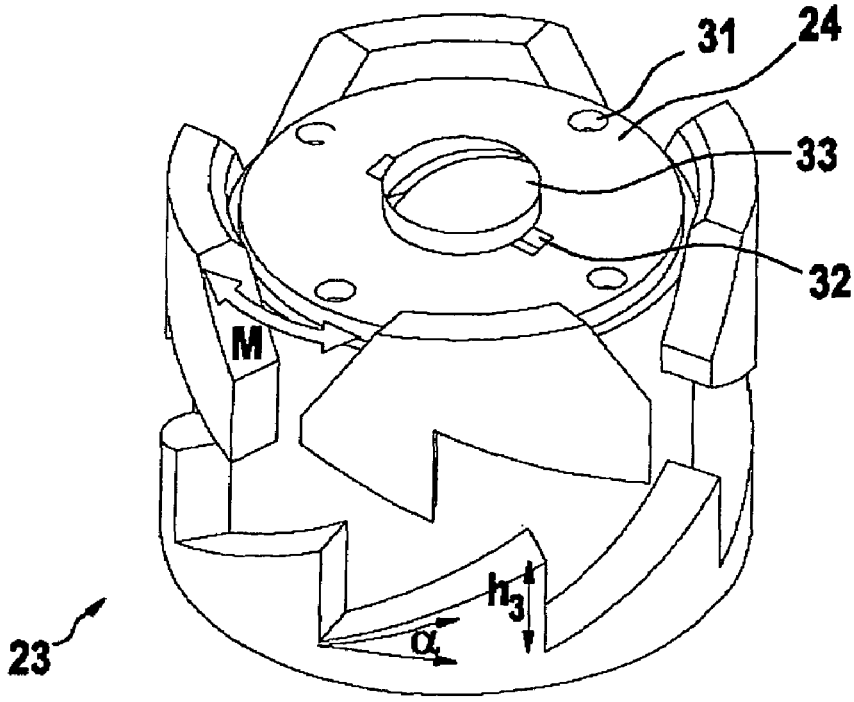
FIG. 3 shows a connecting member in a perspective illustration.
Figure 4:
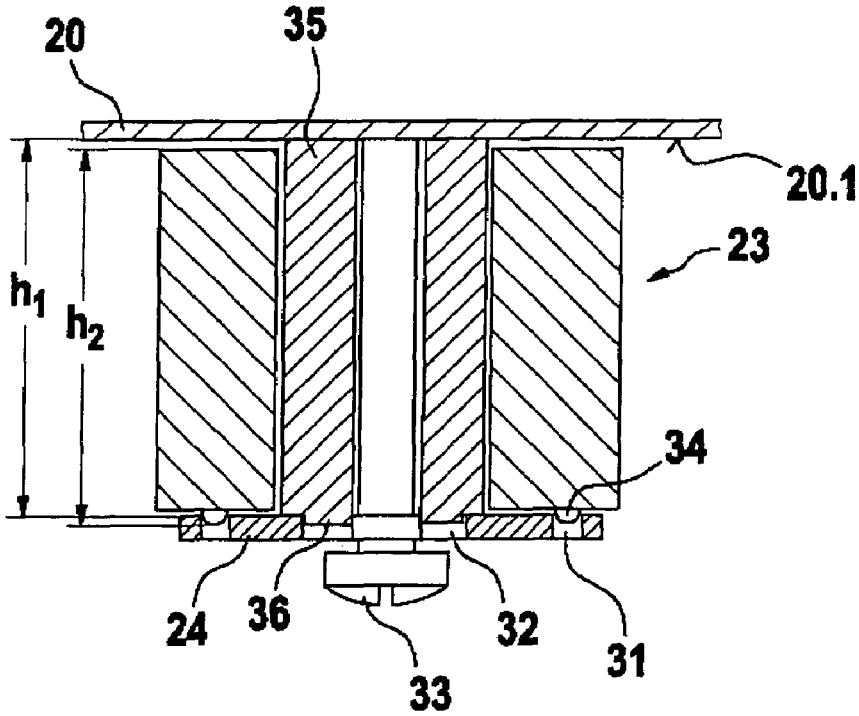
FIG. 4 shows a longitudinal section through the connecting member illustrated in FIG. 3.
Figure 5:
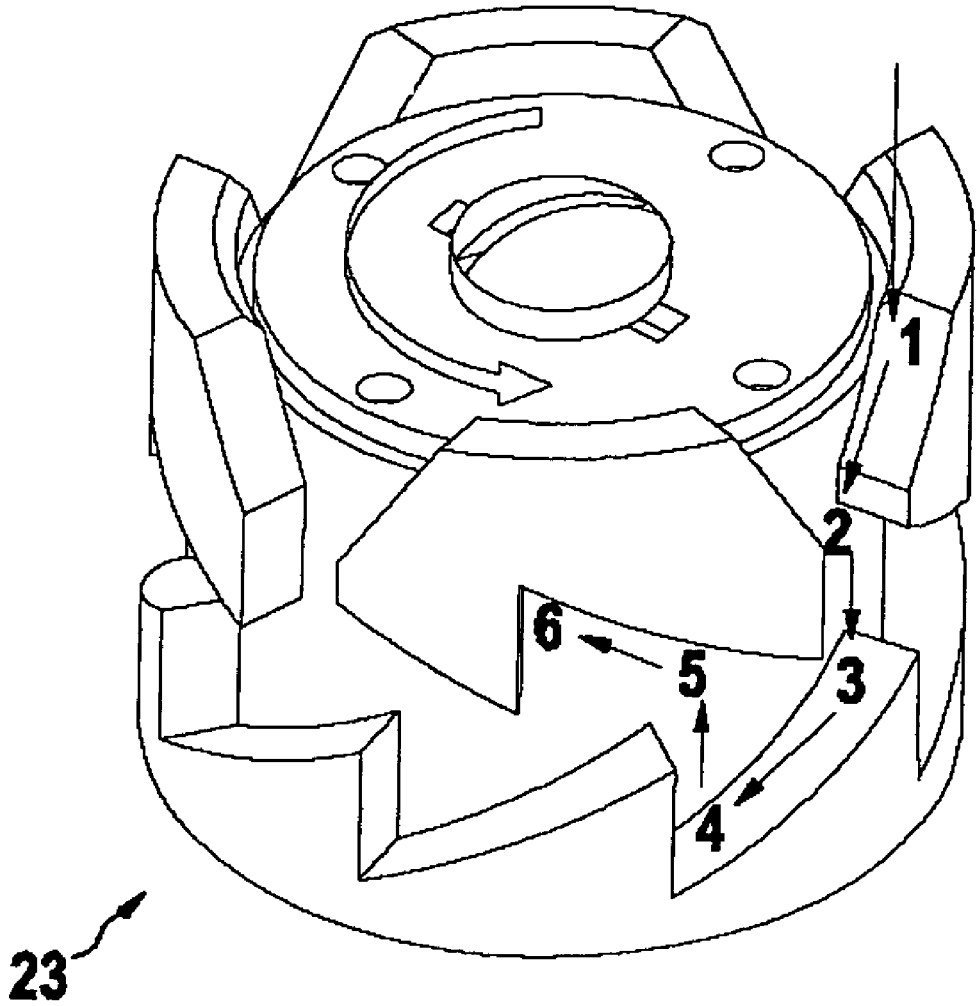
FIG. 5 shows a connecting member with illustration of the rotational movement of a lug engaging in the connecting member during the assembly of the fire detector insert.

In the following, the assembly of fire detector insert 1 and base 20 of the fire detector is described. Fire detector insert 1 is first carefully placed on base 20 and rotated until a position is reached in which fire detector insert 1 may be pressed into base 20 because of a mechanical coding in fire detector insert 1 and base 20. The mechanical coding is caused by lugs 25, 26 projecting radially inward into the interior of base 20, which engage in formfitting grooves 6, 7, 8 on the outer circumference of fire detector insert 1. The mechanical coding ensures that contacts 2 on fire detector insert 1 and contacts 21 on base 20 meet one another in the correct position. In contrast to typical fire detectors, only a very slight application of force is necessary for the rotational movement mentioned, since only the proper position for the coding arrangement must be produced. This slight application of force may be applied without problems even in fire detectors which are mountable flush with the ceiling. After the coding arrangement has been brought into alignment, the final assembly of fire detector insert 1 in base 20 is performed through pressure on fire detector insert 1 in the axial direction. Through this pressure action, fire detector insert 1 moves into the interior of base 20. At the same time, contact face 4 on the back of fire detector insert 1 meets pressure spring 22, positioned centrally in base 20. A generally hollow cylindrical neck 9 rises out of the back of fire detector insert 1. This neck 9 has four lugs 5, projecting outward in the radial direction, on its outer lateral surface, which hold pressure spring 22 on contact face 4 and prevent pressure spring 22 from slipping away laterally during the relative movement between fire detector insert 1 and base 20. The spring force of pressure spring 22 is expediently dimensioned in this case so that it is sufficient, together with the weight of fire detector insert 1, to overcome the friction force of contacts 2, 21 between fire detector insert 1 and base 20 when fire detector insert 1 is removed from base 20. The length of pressure spring 22 is dimensioned so that when fire detector insert 1 is inserted into base 20, there is still no connection between pressure spring 22 and contact face 4 as long as the mechanical coding prevents fire detector insert 1 from being pressed into base 20. This is required since otherwise spring 22 would be pre-tensioned upon a rotation of fire detector insert 1 because of the friction between spring 22 and contact face 4, which may make pressing fire detector insert 1 into base 20 more difficult. As fire detector insert 1 is pressed further into base 20, both lugs 3 meet connecting member 23. Connecting member 23 is rotatably mounted in base 20 and is held by a disk 24 which is attached by a screw 33 (FIG. 2, FIG. 3, FIG. 4). Connecting member 23 is oriented in base 20 in such a way that lugs 3 meet connecting member 23 in two diametrically opposing areas M (FIG. 3). Connecting member 23 has two diagonally running faces in each of these areas M. The correct orientation of areas M in relation to lugs 3 is ensured as follows:

The relative orientation of fire detector insert 1 and therefore also the position of both lugs 3 in relation to base 20 is fixed by the mechanical coding between fire detector insert 1 and base 20 using grooves 6, 7, 8 and lugs 25, 26. Disk 24 is attached using a screw 33 to a dome 35 projecting out of base 20 (FIG. 4). The orientation of disk 24 in relation to base 20 is also determined by a mechanical coding. In this case, this coding is achieved by a recess 32 and disk 24, in which correspondingly formfitting projections 36 which project out of the front face of dome 35 engage. Furthermore, holes 31 are introduced into disk 24, in which lugs 34 projecting out of connecting member 23 engage. Four holes 31 are expediently provided, which are positioned uniformly distributed on a circular arc, i.e., have a spacing of 90° from one another. Correspondingly, four lugs 34 are provided which engage in holes 31. The correct position of areas M of connecting member 23 in relation to base 20 is set with the aid of these holes 31 and lugs 34. If lugs 3 met connecting member 23 outside areas M of connecting member 23, it would not be possible to insert fire detector insert 1 into base 20. Connecting member 23 is geometrically designed so that there is sufficient clearance between connecting member 23, base 20, dome 35, and disk 24 mounted on dome 35. Therefore, connecting member 23 remains rotatable even after mounting of disk 24. In the installed position of base 20, base 20 is mounted in a corresponding recess in the ceiling, and four lugs 34 of connecting member 23 are held by gravity in assigned holes 31 of disk 24. In the ideal case, height h2 of connecting member 23 above lugs 34 is dimensioned in such a way that it is precisely equal to distance hl between disk 24 and base 20 or is somewhat smaller. Therefore, it is ensured that even in the event of vibrations, lugs 34 remain in corresponding holes 31. If, as a result of an axial movement of fire detector insert 1, which has been inserted in the correct position into base 20, lugs 3 meet connecting member 23 in areas M, e.g., at position 1 (FIG. 5), connecting member 23 rotates as fire detector insert 1 is pressed further into base 20 until position 2 has been reached. The rotational movement of connecting member 23 initially ends here, since lugs 3 now slide along a face of connecting member 23 oriented parallel to the longitudinal axis of connecting member 23 and therefore do not exert a torque on connecting member 23. In the further course of the axial movement of fire detector insert 1, lugs 3 again meet a diagonally running face of connecting member 23 in position 3, through which a torque is again exerted on connecting member 23. As a result, connecting member 23 rotates further around dome 35 until position 4 has been reached. In position 4, fire detector insert 1 is pressed furthest into base 20. If fire detector insert 1 is now relieved of the axial pressure again, pressure spring 22, supported by the weight of fire detector insert 1, presses fire detector insert 1 vertically downward, viewed from the surface of the ceiling, until lug 3 again meets connecting member 23 in position 5. A torque is thus again exerted on connecting member 23, which subsequently rotates further until position 6 is reached. Fire detector insert 1 is locked solidly in base 20 in this position. In comparison to a starting position, connecting member 23 has been rotated by approximately 45°.

Figure 6:
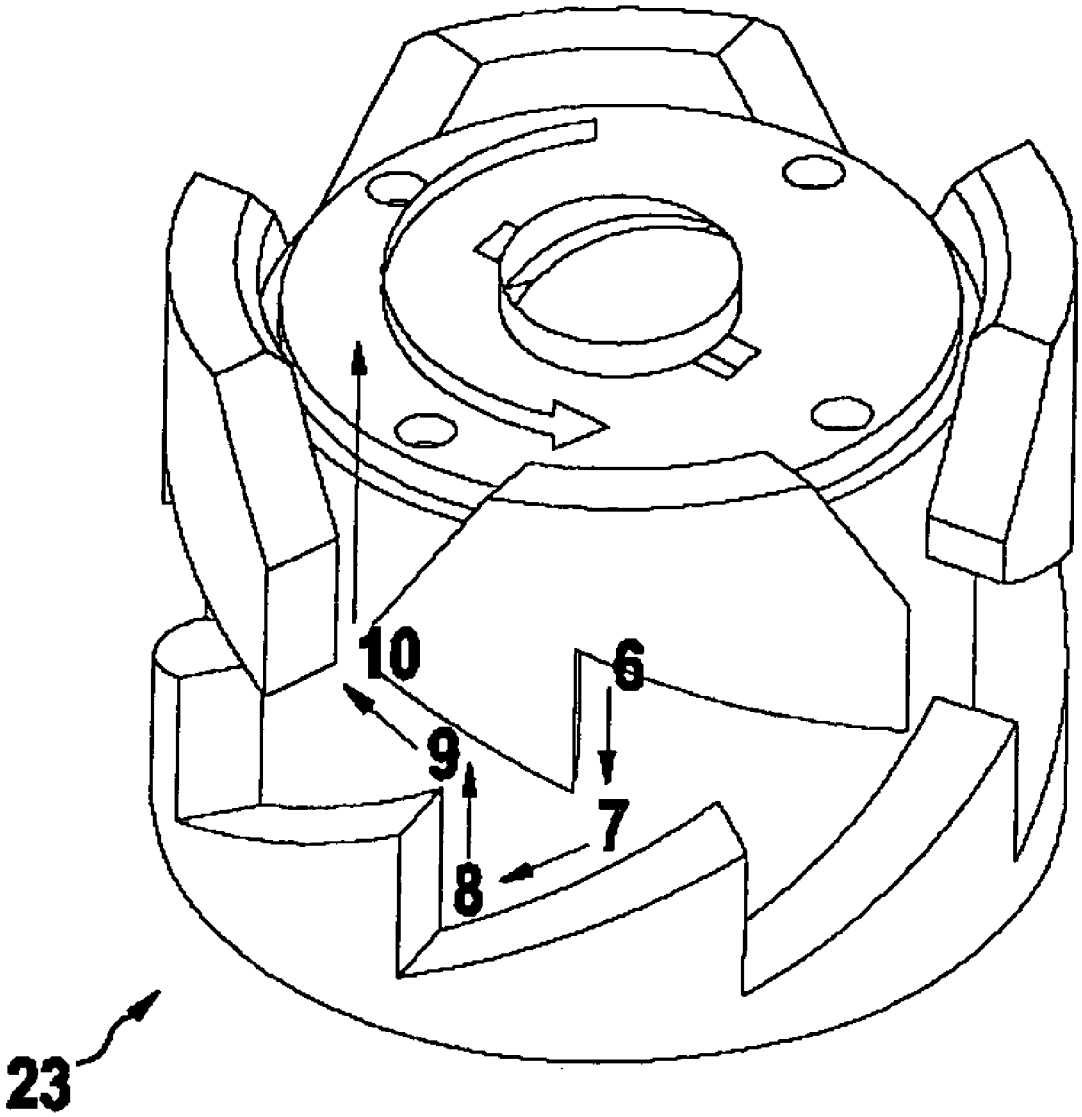
FIG. 6 shows a connecting member with illustration of the rotational movement of a lug engaging in the connecting member during the disassembly of the fire detector insert.

The movement sequence when removing fire detector insert 1 from base 20 will now be described with reference to FIG. 6. To remove fire detector insert 1 from base 20, a pressure is again applied to fire detector insert 1 in the axial direction, which in turn moves fire detector insert 1 in the axial direction and is thus again pressed further into base 20. Starting from the rest position of lugs 3 in position 6 of connecting member 23, in position 7 the lugs now again reach a diagonally set face of connecting member 23 and therefore again apply a torque to connecting member 23. Under the influence of this torque, connecting member 23 rotates further until lugs 3 have reached position 8. If fire detector insert 1 is now relieved of the applied axial pressure, it moves, with the pressure of pressure spring 22 and gravity applied to it, downward, i.e., out of base 20 in the axial direction. In this case, lugs 3 of the fire detector insert again slide along a face which is parallel to the longitudinal axis direction of connecting member 23, so that they do not exert a torque on connecting member 23. In position 9, lugs 3 again meet a diagonally set control face of connecting member 23. A torque is thus exerted on connecting member 23, which now rotates further until lugs 3 of the fire detector insert reach a control face of connecting member 23 oriented parallel to the longitudinal axis direction of connecting member 23 in position 10 and are now released by connecting member 23. Overall, connecting member 23 has rotated by approximately 90° in comparison to its starting state before the insertion of fire detector insert 1 into base 20. After the removal of fire detector insert 1 from base 20, connecting member 23 is again fixed by lugs 34, which engage in holes 31 in disk 24.

Of course, it is also possible in a further exemplary embodiment of the present invention to exchange the position of connecting member 23 and the position of lugs 3 cooperating with connecting member 23. This means that in this exemplary embodiment, the connecting member would be connected to fire detector insert 1 itself, while lugs 3 cooperating with connecting member 23 would be connected to base 20 of the fire detector.

Since, as described above, generally only a force in the axial direction must be applied to attach fire detector insert 1 in base 20 and/or remove it from base 20, the achievement of the object according to the present invention is particularly advantageously suitable for ceiling-flush fire detectors, which have no parts projecting out of the plane of the ceiling, to which a force acting in the radial direction could be applied.

The behavior of the locking mechanism described above may be optimized through the following influencing variables. A specific frictional force is overcome as connecting member 23 is rotated. If fire detector insert 1 is pressed into base 20 using a predefinable force F, component F $\sin(\alpha)$ is available for the rotational movement, $\alpha$ being the slope of control faces connected to connecting member 23. Furthermore, lugs 3 move on connecting member 23 as connecting member 23 rotates, which results in an additional frictional force. This frictional force is proportional to F $\cos(\alpha)$. Because of this relationship the larger the slope of the control faces is, the smaller force F is, using which fire detector insert 1 must be pressed into base 20 in the axial direction in order to move connecting member 23.

Slope a may expediently be increased by increasing the number of areas M at a predefined diameter of connecting member 23. Furthermore, slope $\alpha$ may be increased by reducing the diameter of connecting member 23 at a predefined number of areas M. Finally, slope $\alpha$ may also be increased by not implementing the area between two end points of the diagonally running control faces of connecting member 23 as a straight line, but rather providing a larger slope $\acute{\alpha}>\alpha$ in the central area between the end points. For the same height h3 (FIG. 3), the slope in proximity to the two end points of the front faces must then be reduced. If the size of the area in which the slope is reduced is smaller than the dimensions (diameter) of lugs 3, the function of the connecting member is therefore not impaired. It is then ensured that when lug 3 meets connecting member 23 (in position 3), the contact point between the lug and the connecting member comes to rest in the area of the control face having greater slope $\acute{\alpha}$. If the end of the control face is reached in position 4, the contact point between lug 3 and the control face is still in the area of the control face having greater slope $\acute{\alpha}$.

Figure 7:
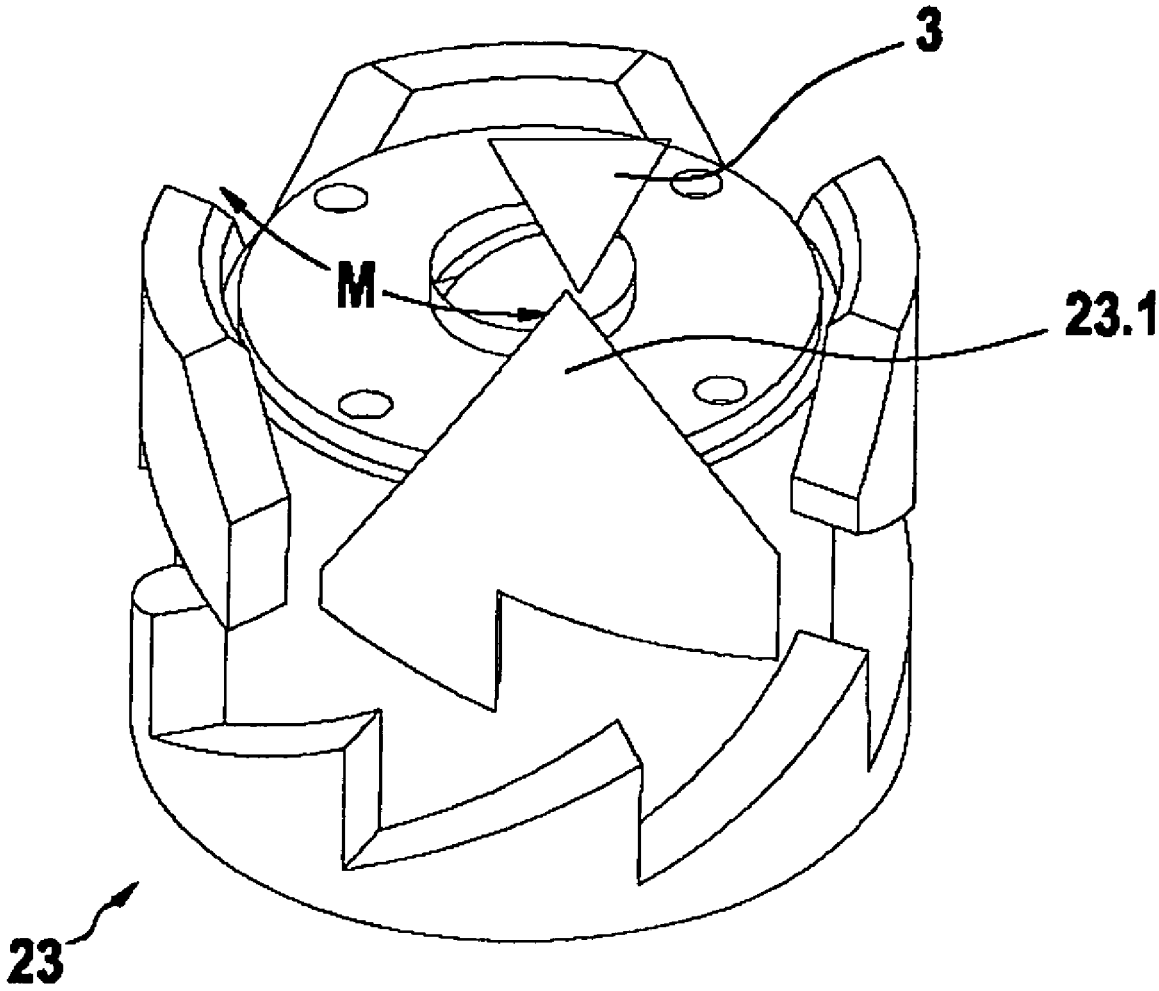
FIG. 7 shows a further exemplary embodiment of a connecting member.

An advantageous further embodiment variant of connecting member 23 is described in the following with reference to FIG. 7. Connecting member 23 is designed in this case in such a way that area M of connecting member 23, which lug 3 positioned on fire detector insert 1 meets, now forms a cone angle of 90°. In addition, at least one projection 23.1 of connecting member 23 is implemented as a triangle. Furthermore, lug 3 is also designed as a triangle. This has the advantage that now lug 3 may meet connecting member 23 in any arbitrary relative orientation in relation to connecting member 23. The orientation of connecting member 23 in relation to base 20 must therefore no longer necessarily be set via disk 24.

After fire detector insert 1 has been inserted into base 20 and engaged there, the weight of fire detector insert 1 is carried by the two lugs 3. In addition, lugs 3 must withstand the spring force of pressure spring 22, which is now tensioned. The larger the dimensions of lugs 3, the more stable they are. However, with increasing size, the dimensions of connecting member 23 and therefore the path which fire detector insert 1 must travel perpendicularly to the ceiling when being inserted also increase automatically. The larger this path, the larger the dimensions of base 20 and therefore also the larger the recess required for installing the fire detector in the ceiling. Therefore, more than two lugs 3 may be necessary to increase the mechanical stability with small dimensions of lugs 3.

What is claimed is:

1. A fire detector, comprising:

a base; and a fire detector insert connectable to the base;

wherein:

the fire detector insert is configured to be connected to the base through an axial movement and removable from the base through a subsequent axial movement;

the base carries a centrally positioned dome which projects out of a bottom of the base; and the base includes a disk which is attached to at least one of the dome and the base by a screw which penetrates a hole of the dome.

2. The fire detector as recited in claim 1 further comprising:

a catch that locks the fire detector insert inserted into the base through a first axial movement in a first catch position and releases the fire detector insert after a subsequent second axial movement in a second catch position.

3. The fire detector as recited in claim 1 wherein the dome is a hollow cylinder and has at least one projection projecting out of a front face of the dome, facing away from the bottom of the base.

4. The fire detector as recited in claim 1, wherein the disk is configured to be connected to the dome in a rotatably fixed manner.

5. The fire detector as recited in claim 1, wherein the disk has at least one recess in which a projection projecting out of the dome engages, whereby the disk is connected to the dome in a rotatably fixed manner.

6. The fire detector as recited in claim 1, wherein the disk has at least one hole, which is introduced into the disk at a distance to a center point of the disk, parallel to a surface normal.

7. A fire detector comprising:

a base; and a fire detector insert connectable to the base;

wherein:

the fire detector insert is configured to be connected to the base through an axial movement and removable from the base through a subsequent axial movement;

the base carries a centrally positioned dome which projects out of a bottom of the base; and the base includes a connecting member, which is mounted on the dome so it is rotatable and encloses the dome.

8. The fire detector as recited in claim 7, wherein the connecting member includes a catch arrangement to engage with the disk.

9. The fire detector as recited in claim 8, wherein the catch arrangement includes at least one lug that projects out of a front face of the connecting member, facing away from the bottom of the base.

10. The fire detector as recited in claim 9, wherein a height of the connecting member, measured via the lug projecting out of a front face of the connecting member, corresponds to or is slightly smaller than a height corresponding to a distance of the disk from the bottom of the base.

11. The fire detector as recited in claim 7, wherein the connecting member carries diagonally set control faces on its circumference, and a torque, which sets the connecting member in rotation, is able to be exerted on the connecting member by applying a force on the control faces.

12. The fire detector as recited in claim 11, wherein the control faces of the connecting member is able to be operationally linked to lugs positioned on the fire detector insert so that the connecting member is able to be set into a rotational movement through an axial movement of the fire detector insert.

13. The fire detector as recited in claim 7, wherein the connecting member includes at least one projection in a form of a triangle.

14. The fire detector as recited in claim 1, wherein the fire detector insert carries a neck implemented as a hollow cylinder on its back, which concentrically encloses the dome positioned in the base after the fire detector insert is installed in the base.

15. The fire detector as recited in claim 14, wherein a plurality of lugs, which project radially outward, are provided on an outer circumference of the neck.

16. The fire detector as recited in claim 15, wherein the lugs are distributed uniformly around the circumference of the neck.

17. The fire detector as recited in claim 14, wherein lugs, which project radially inward, are provided around an inner circumference of the neck.

18. The fire detector as recited in claim 17, wherein at least two of the lugs are diametrically opposed to one another.

19. The fire detector as recited in claim 1, wherein the insert and the base include a coding arrangement for unambiguous orientation to one another.

20. The fire detector as recited in claim 19, wherein lugs which project radially inward and engage in formfitting grooves in an outer circumference of the insert are the coding arrangement of the base.

21. The fire detector as recited in claim 1, wherein the base includes a pressure spring that concentrically encloses the dome and fixes the insert in a catch position in an installed position.

* * * * *